US005751101A

United States Patent [19]

Takanobu et al.

[11] Patent Number: 5,751,101

[45] Date of Patent: May 12, 1998

[54] CATHODE RAY TUBE HAVING A CONTACT SPRING FIXED TO AN END OF THE SHIELD CUP WITH A MICRO VICKERS HARDNESS OF 250-400

[75] Inventors: Hiroshi Takanobu, Mobara; Akimasa Ishikawa, Nagara-machi, both of Japan

[73] Assignees: Hitachi, Ltd., Tokyo; Hitachi Electronic Devices Co., Ltd., Chiba-ken, both of Japan

[21] Appl. No.: 789,777

[22] Filed: Jan. 28, 1997

[30] Foreign Application Priority Data

Mar. 4, 1996 [JP] Japan ..... 8-046311

[51] Int. Cl.[6] ..... H01J 28/80

[52] U.S. Cl. ..... 313/405

[58] Field of Search ..... 313/364, 402, 313/403, 404, 405, 406, 407, 408, 446

[56] References Cited

U.S. PATENT DOCUMENTS 4,432,464 2/1984 Seats et al. ..... 313/264

4,665,338 5/1987 Inaba et al. ..... 414/402

5,578,898 11/1996 Higashinakagawa et al. ..... 313/402

FOREIGN PATENT DOCUMENTS 2104638 4/1990 Japan .

*Primary Examiner*—William L. Oen

*Attorney, Agent, or Firm*—Antonelli, Terry, Stout, & Kraus, LLP

[57] ABSTRACT

A cathode ray tube has a contact spring 30 which is fixed at one end to a shield cup 27 provided on an anode electrode 26 of an electron gun assembly and is pressed at the other end against an electrically conductive coating 3a applied to an inner wall of a funnel portion 3, so as to provide a reliable electrical connection between the anode electrode 26 and the electric conductive coating 3a and to hold the electron gun assembly coaxially in the neck portion 2. The contact spring 30 is made of an alloy material which is composed of 30–35 wt % nickel (Ni), 19–23 wt % chromium (Cr) and the balance of which is substantially iron (Fe), and which has a micro Vickers hardness of 250–400.

6 Claims, 6 Drawing Sheets

CATHODE RAY TUBE HAVING A CONTACT SPRING FIXED TO AN END OF THE SHIELD CUP WITH A MICRO VICKERS HARDNESS OF 250-400

BACKGROUND OF THE INVENTION

Field of the Invention

The present invention relates to a cathode ray tube and, more particularly, to a cathode ray tube in which an electric discharge is suppressed by preventing an electrically conductive coating from being scraped due to contact and rubbing between an elastic member provided on an electron gun assembly and the electrically conductive coating applied to the inner wall of the vacuum vessel which constitutes the cathode ray tube.

In general, a vacuum vessel which constitutes a color cathode ray tube includes a face panel portion, which operates as an image display portion, a neck portion in which an electron gun assembly is accommodated, and a funnel portion which interconnects the face panel portion and the neck portion. A phosphor screen is formed on the inner wall of the face panel portion, and a shadow mask, which is a color selective electrode, is disposed close to the phosphor screen where it is supported by support springs. An electrically conductive coating, which is essentially made of graphite, is applied to the inner wall of the funnel portion.

Three electron beams emitted from the electron gun assembly toward the phosphor screen are deflected by the deflection magnetic field generated by a deflection yoke, which is provided around the outside of the transitional region from the funnel portion to the neck portion. After being subjected to color selection by the shadow mask, the respective electron beams strike predetermined color phosphors on the phosphor screen to produce a color image.

The electron gun assembly includes a plurality of electrodes, and a shield cup is disposed at the front end of the electron gun assembly. A plurality of contact springs are disposed on the shield cup. The contact springs hold the electron gun assembly at a predetermined position within the neck portion and provide an electrically conductive connection between the shield cup and the conductive coating applied to the inner wall of the funnel portion.

A color cathode ray tube is also known in which one end of a getter spring is fixed to the shield cup and a getter disposed at the other end of the getter spring is pressed against an electrically conductive coating.

Since contact springs and the getter spring are pressed against the electrically conductive coating, a so-called elastic alloy material, which essentially contains nickel (Ni), is employed for the contact springs and the getter spring to prevent peeling of the electrically conductive coating due to vibrations or the like and to ensure that a good electrical connection between the shield cup and the electrically conductive coating will be maintained.

Specifically, the elastic alloy material is an alloy material (75/15 inconel alloy) which is composed of 72–78 wt % nickel (Ni), 14–16.6 wt % chromium (Cr) and the balance of which is substantially iron (Fe), and has a micro Vickers hardness of approximately 300–350, or an alloy material (stainless steel) which is composed of 13–15 wt % nickel (Ni), 15–17 wt % chromium (Cr) and the balance of which is substantially iron (Fe), and has a micro Vickers hardness of approximately 150–250.

SUMMARY OF THE INVENTION

In the case where an alloy material (75/15 inconel alloy), which is composed of 72–78 wt % nickel (Ni), 14–16.6 wt % chromium (Cr) and the balance of which is substantially iron (Fe), and has a micro Vickers hardness of approximately 300–350, is employed for the contact springs and getter springs secured to the shield cup of an electron gun assembly, since the content of nickel (Ni) in the alloy is large, the alloy material is expensive.

In the case of contact and getter springs made of an alloy material (stainless steel), which is composed of 13–15 wt % nickel (Ni), 15–17 wt % chromium (Cr) and the balance of which is substantially iron (Fe), and has a micro Vickers hardness of approximately 150–250, a large amount of scrapings of an electrically conductive coating due to the friction between the contact springs and the conductive coating are produced when the electron gun assembly is inserted into the neck portion of a vacuum vessel. Since the scrapings of the electrically conductive coating cannot be completely removed from the inside of the vacuum vessel, there is a problem in that the scrapings remaining in the neck portion cause sparking during the operation of the cathode ray tube and have a tendency to block the electron beam passing openings in the shadow mask, so as to degrade the display image.

An object of the present invention is to solve above-described problems and provide a cathode ray tube which is capable of producing a high quality image display at a low cost by suppressing the scraping of the electrically conductive coating and by preventing sparking and shadow mask aperture blocking.

The cathode ray tube according to the present invention comprises a vacuum vessel including a face panel portion, a neck portion and a funnel portion which interconnects the face panel portion and the neck portion, a phosphor screen formed on the inner surface of the face panel portion, a color selective electrode disposed close to the phosphor screen and supported on a peripheral inner wall of the face panel portion via support springs, an electron gun assembly accommodated in the neck portion, and a plurality of contact springs each of which is fixed at one end to a shield cup of the electron gun assembly and is pressed at the other end against an electrically conductive coating applied to an inner wall of the funnel portion, so as to hold the electron gun assembly and to provide an electrically conductive connection between the conductive coating and the shield cup. The contact springs are made of an alloy material which is composed of 30–35 wt % nickel (Ni), 19–23 wt % chromium (Cr) and the balance of which is substantially iron (Fe), and has a micro Vickers hardness of 250–400.

The cathode ray tube according to the present invention also includes a getter spring which is fixed at one end to the shield cup of the electron gun assembly and holds a getter at the other end which is in contact with the electrically conductive coating, and the getter spring is made of an alloy material which is composed of 30–35 wt % nickel (Ni), 19–23 wt % chromium (Cr) and the balance if which is substantially iron (Fe), and has a micro Vickers hardness of 250–400.

In the cathode ray tube according to the present invention, the support springs for supporting a shadow mask are made of an alloy material which is composed of 30–35 wt % nickel (Ni), 19–23 wt % chromium (Cr) and the balance of which is substantially iron (Fe), and has a micro Vickers hardness of 250–400.

The cathode ray tube according to the present invention is not limited to a color cathode ray tube, but may also be a projection type cathode ray tube or a monochrome cathode ray tube. A spring member which is provided on an electron gun assembly accommodated in such a cathode ray tube is made of an alloy material which is composed of 30–35 wt % nickel (Ni), 19–23 wt % chromium (Cr) and the balance on which is substantially iron (Fe), and has a micro Vickers hardness of 250–400.

Compared with a cathode ray tube using conventional alloy materials for the contact spring and the getter spring, in the case of the cathode ray tube according to the present invention, the spring displacement due to application of an external force is approximately the same, but the scraping of the electrically conductive coating is extremely small.

The displacements of contact springs having approximately the same shape, but made of different materials, were measured at a sample temperature of 25° C. while a load was being applied to the contact springs. Samples made of the following materials were prepared: an alloy material "a" (0.19 mm thick) identical to that used for the cathode ray tube of the present invention, i.e., an alloy material which was composed of 30–35 wt % nickel (Ni), 19–23 wt % chromium (Cr) and the balance of which was substantially iron (Fe), and having a micro Vickers hardness of 250–400; a prior-art alloy (stainless steel) material "b" (0.18 mm thick) which was composed of 13–15 wt % nickel (Ni), 15–17 wt % chromium (Cr) and the balance of which was substantially iron (Fe), and having a micro Vickers hardness of 150–250; and another prior-art alloy (75/15 inconel alloy) material "c" (0.18 mm thick) which was composed of 72–78 wt % nickel (Ni), 14–16.6 wt % chromium (Cr) and the balance of which was substantially iron (Fe), and having a micro Vickers hardness of 300–350. As shown in FIG. 1, each of the aforesaid alloy materials was formed into a sample having the shape of a contact spring of 4 mm in width and 14.5 mm in length (1). Each of the samples was fixed at one end to a shield cup 27 of an electron gun assembly 9, and its spring displacement (h) was measured with a tensile strength testing apparatus (Tensilone, manufactured by ORIENTEC In. Co.) while a load (W) of 0–200 g was being applied to the other end of each of the samples.

As shown in FIG. 2, the contact spring using the alloy material "a" for the cathode ray tube of the present invention provided approximately the same displacement as the contact springs employing the alloy materials "b" and "c" of the prior art. However, in an electrically conductive coating scrape test performed by pressing the electron gun assemblies 9 made of the respective alloy materials into a vacuum vessel to the inner surface of which an electrically conductive coating was applied, the electrically conductive coating was scraped in the case of the contact springs employing the respective prior-art alloy materials "b" and "c", whereas no scraping of the electrically conductive coating was observed in the case of the contact spring employing the alloy material "a" for the cathode ray tube of the present invention.

FIG. 3 is a graph showing the relation between the depth of scraping (mm) of an electrically conductive coating and the content of nickel (Ni) in the total weight of an alloy, and the relation between the depth of scraping (mm) of the electrically conductive coating and the micro Vickers hardness of the alloy material.

The sample shown in FIG. 3 was obtained by adding a predetermined amount of nickel (Ni) to a base alloy which contained chromium and iron at a weight ratio of 1:2.2, and subjecting the resultant alloy to heat treatment. The composition of the alloy shown in FIG. 3 can be confirmed by an SEM-WDX (Scanning Electron Microscope-Wavelength Dispersive X-ray Spectrometer) analysis method or an SEM-EDX (Scanning Electron Microscope-Energy Dispersive X-ray Spectrometer) analysis method. Although the value of depth of the deepest portion was measured as the depth of scraping of the electrically conductive coating by using an optical microscope, any of a scanning electron microscope, a needle contacting type surface roughness measuring apparatus, a scanning tunnel current microscope and the like may be employed. As shown by curve "d" in FIG. 3, as the micro Vickers hardness increases, the scrape in the electrically conductive coating becomes deeper. The slope of curve "d" is moderate when the micro Vickers hardness is in the range of 0 to 400, but if the micro Vickers hardness exceeds 400, the slope becomes steep, i.e., a large amount of the electrically conductive coating is scraped, and the electrical breakdown property of the cathode ray tube is degraded. If the micro Vickers hardness is less than 250, the alloy having the employed composition comes to have a smaller elasticity, so that an electron gun assembly cannot be fixed and held at a predetermined position in the glass tube of the neck portion reliably, and the characteristics of the cathode ray tube become degraded.

As shown by curve "e" in FIG. 3, the depth of a scrape (mm) in the electrically conductive coating becomes deeper with a decrease of the nickel (Ni) content (wt %). If the nickel (Ni) content becomes less than 25 wt %, the slope of curve "e" becomes steeper, so that a large amount of the electrically conductive coating is scraped and the electrical breakdown property of the cathode ray tube is degraded. Incidentally, as shown in FIG. 3, as the content of nickel becomes larger, the micro Vickers hardness becomes smaller.

As is further apparent from FIG. 3, if an alloy material having a micro Vickers hardness of 250–400 and containing more than 25 wt % nickel (Ni) is used for a contact spring, the scrape in the electrically conductive coating is remarkably small.

Substantially similarly to the contact spring employing the prior art alloy material, a contact spring made of the alloy material for the cathode ray tube according to the present invention is capable of providing reliable electrical connection between the electron gun assembly and the electrically conductive coating and of holding the electron gun assembly at a predetermined position in the glass tube of the neck portion.

The alloy material of the contact spring for the cathode ray tube according to the present invention is inexpensive because nickel (Ni) is present at 30–35 wt %, chromium (Cr) is present at 19–23 wt %, the balance being substantially iron (Fe), and the content of nickel (Ni) is less than ½ of the content of nickel (Ni) in the prior-art alloy material "c" (75/15 inconel alloy).

In addition, since the alloy material of the contact spring for the cathode ray tube according to the present invention is composed of 30–35 wt % nickel (Ni), 19–23 wt % chromium (Cr) and the balance of which is substantially iron (Fe), and has a micro Vickers hardness of 250–400, the depth of a scrape in the electrically conductive coating becomes less than about ⅓ of the depth of a scrape when using the prior-art alloy material (stainless steel) "b".

DETAILED DESCRIPTION OF THE PREFERRED EMBODIMENTS

The cathode ray tube according to the present invention includes contact springs each fixed at one end to a shield cup provided at the front end of an electron gun assembly and pressed at the other end against an electrically conductive coating applied to an inner wall of a funnel portion of the tube envelope, so as to hold the electron gun assembly and to provide an electrical connection between the conductive coating and the shield cup, and the contact springs are made of an alloy material which is composed of 30–35 wt % nickel (Ni), 19–23 wt % chromium (Cr) and the balance of which is substantially iron (Fe), and having a micro Vickers hardness of 250–400. Accordingly, the electron gun assembly and the conductive coating can be reliably electrically connected to each other without scraping the conductive coating, and the electron gun assembly is held at a predetermined position within the neck portion of the glass tube.

Figure 4:
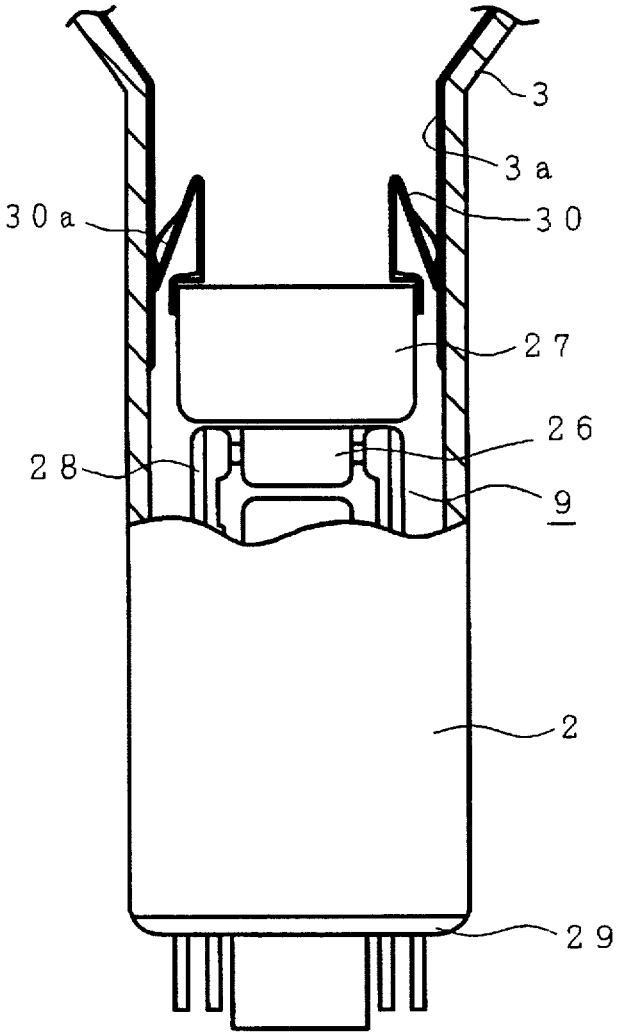
FIG. 4 is a side cross-sectional view of the essential portion of a cathode ray tube representative of an embodiment according to the present invention.

An embodiment of the present invention will be described below in detail with reference to the accompanying drawings:

FIG. 4 is a cross-sectional view of the essential portion of an embodiment of a cathode ray tube according to the present invention. The cathode ray tube shown in FIG. 4 includes a neck portion 2, a funnel portion 3, an electrically conductive coating 3*a*, an electron gun assembly 9, an anode 26, a shield cup 27, a beading glass 28, a stem 29 and contact springs 30.

As shown in FIG. 4, the conductive coating 3*a* is applied to the inner wall of the funnel portion 3 and part of the neck portion 2 of the vacuum vessel which constitutes the cathode ray tube. This conductive coating 3*a* has the function to transmit a high voltage (anode voltage) applied to an anode button (not shown) provided in the funnel portion 3 to the anode 26 of the electron gun assembly 9, and the anode 26 and the electrically conductive coating 3*a* are electrically connected to each other via the contact springs 30 and the shield cup 27.

The contact springs 30 are bent strips made of an elastic alloy material, and one end of each of the contact springs 30 is fixed to the shield cup 27, while the other end has a press contact portion 30*a* comprising a smooth projection which presses against the conductive coating 3*a* applied to the inner wall of the funnel portion 3. These press contact portions 30*a* elastically contact the electrically conductive coating 3*a* to provide a good electrical connection, and serve to hold the electron gun assembly 9 coaxially with the tube axis in the neck portion 2.

Figure 1:
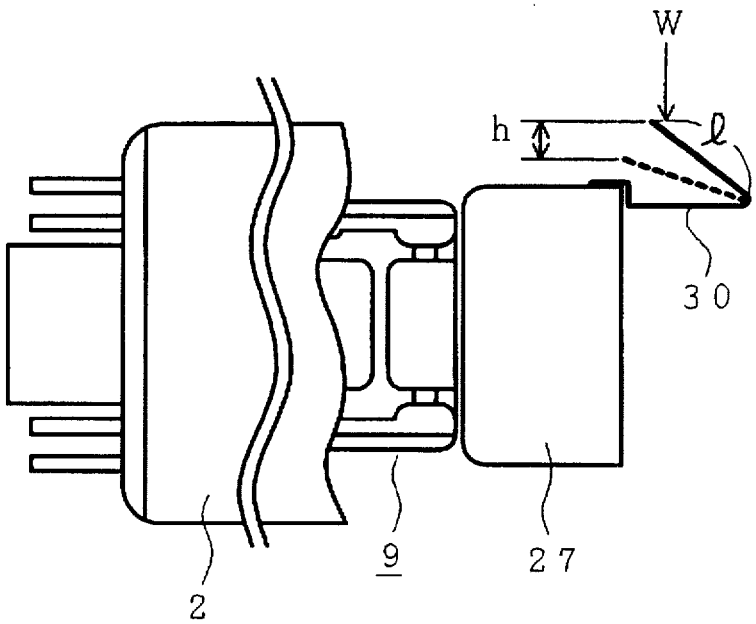
FIG. 1 is a side plan view of a displacement measurement sample of a contact spring fixed at one end to a shield cup.
Figure 2:
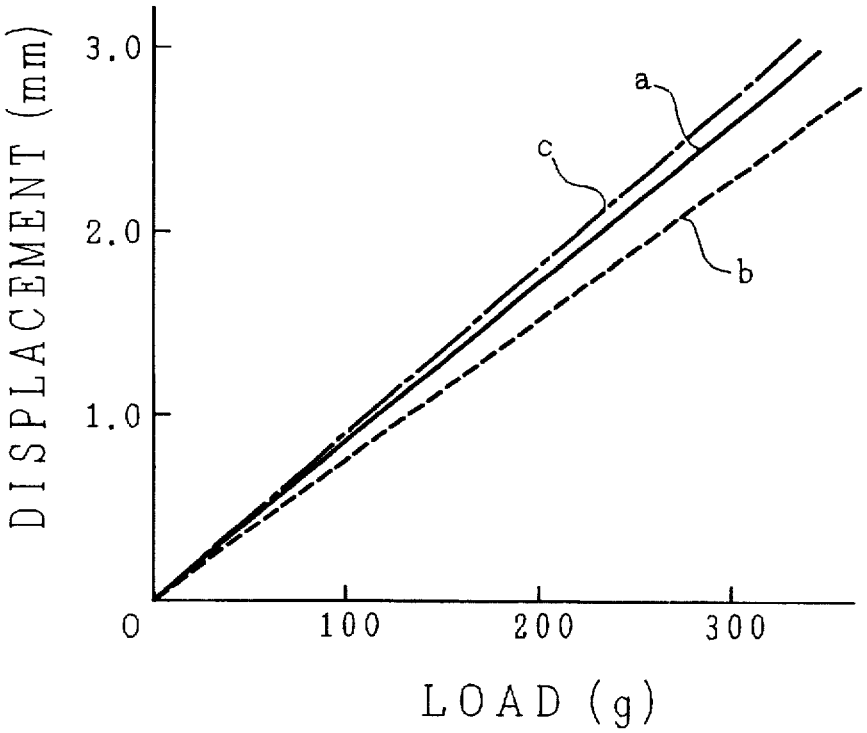
FIG. 2 is a graph showing spring displacements when a load is applied to contact springs made of different materials.
Figure 3:
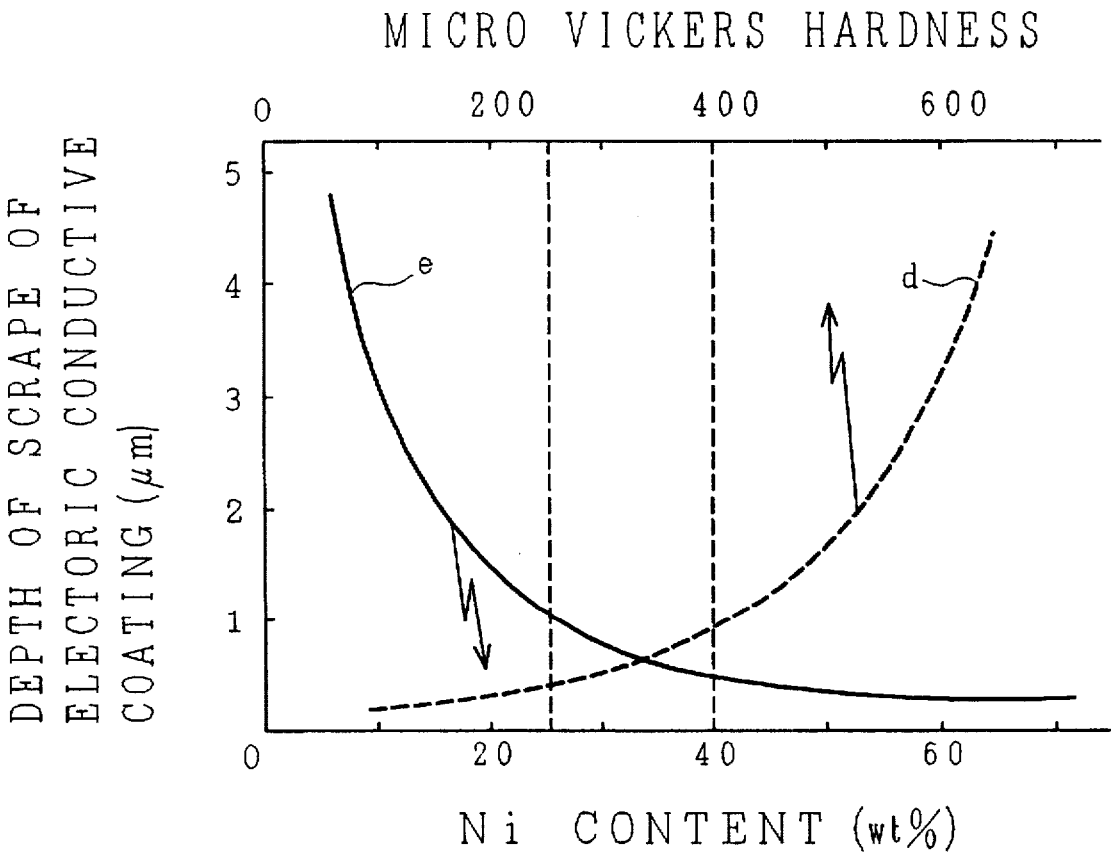
FIG. 3 is a graph showing the relation "d" between the depth of a scrape (mm) in an electrically conductive coating and the micro Vickers hardness of an alloy material, and the relation "e" between the depth of a scrape (mm) in the electrically conductive coating and the content (wt %) of nickel (Ni) in the alloy.

The contact springs 30 are made of the alloy material composed of 30–35 wt % nickel (Ni), 19–23 wt % chromium (Cr) and the balance of which is substantially iron (Fe), as shown by curve "a" of the graph of FIG. 2, and having a micro Vickers hardness of approximately 300–350. Incidentally, the micro Vickers hardness was measured by using an HMV-2000 micro-hardness measuring apparatus manufactured by Shimadzu-Seisakusyo In. Co. In this measurement, the same sample was measured five times at a sample temperature of 25° C. and the average value of the measured values was determined as the micro Vickers hardness of the sample.

The repulsive force of each of the contact springs 30 of the present embodiment to which the aforesaid alloy material is applied is approximately equal to that of a spring of a conventional alloy material (stainless steel) which is composed of 13–15 wt % nickel (Ni), 15–17 wt % chromium (Cr) and the balance of which is substantially iron (Fe), and having a micro Vickers hardness of approximately 200–250, and to that of a spring of a conventional alloy material (75/15 inconel alloy) which is composed of 72–78 wt % nickel (Ni), 14–16.6 wt % chromium (Cr) and the balance of which is substantially iron (Fe), and having a micro Vickers hardness of more than 300.

In contrast, when the contact springs 30 were made of either of the conventional alloy materials, i.e., the alloy material (stainless steel) which is composed of 13–15 wt % nickel (Ni), 15–17 wt % chromium (Cr) and the balance of which is substantially iron (Fe), and having a micro Vickers hardness of approximately 200–250, or the alloy material (75/15 inconel alloy) which is composed of 72–78 wt % nickel (Ni), 14–16.6 wt % chromium (Cr) and the balance of which is substantially iron (Fe), and having a micro Vickers hardness of more than 300, a large amount of scraping of the electrically conductive coating 3*a* due to the friction between the contact springs 30 and the conductive coating 3*a* was observed when the electron gun assembly was inserted into a neck portion of the glass tube 1.

Incidentally, in the case of the present embodiment employing an alloy material, which is composed of 30–35 wt % nickel (Ni), 19–23 wt % chromium (Cr) and the balance of which is substantially iron (Fe), and having a micro Vickers hardness of 300–350, no scraping of the electrically conductive coating 3*a* was observed.

The contact springs using the alloy material according to the present embodiment are equivalent to those of the prior art in their electrical connection characteristics for the connection between the electron gun assembly and the electrically conductive coating or in their ability to hold the electron gun assembly coaxially at a predetermined position in the neck portion of the glass tube.

In the alloy material of the present embodiment, which is composed of 30–35 wt % nickel (Ni), 19–23 wt % chromium (Cr) and the balance of which is substantially iron (Fe), and having a micro Vickers hardness of 300–350, the content of expensive nickel (Ni) can be reduced to a half or less, compared to the conventional alloy material (75/15 inconel alloy) which is composed of 72–78 wt % nickel (Ni), 14–16.6 wt % chromium (Cr) and the balance of which is substantially iron (Fe), and which has a micro Vickers hardness of 300–350.

In a cathode ray tube in which one end of a getter spring is secured to the shield cup of an electron gun assembly, and a getter is mounted on the getter spring in the vicinity of the other end thereof which is pressed against an electrically conductive coating, an alloy material similar to the alloy material of the aforesaid contact springs 30, i.e., an alloy material which is composed of 30–35 wt % nickel (Ni), 19–23 wt % chromium (Cr) and the balance of which is substantially iron (Fe), and which has a micro Vickers hardness of 250–400, can be used for the getter spring. In this case as well, the aforesaid other end of the getter spring does not scrape the electrically conductive coating applied to the funnel inner wall.

Further, the aforesaid alloy material which is composed of 30–35 wt % nickel (Ni), 19–23 wt % chromium (Cr) and the balance of which is substantially iron (Fe), and which has a micro Vickers hardness of 250–400, can also be used for support springs for supporting a shadow mask disposed close to the inner surface of the face panel portion of a color cathode ray tube.

An example of the construction of the electron gun assembly used in the cathode ray tube of the present embodiment and a cathode ray tube provided with this electron gun assembly will be described below with reference to FIG. 5.

Figure 5:
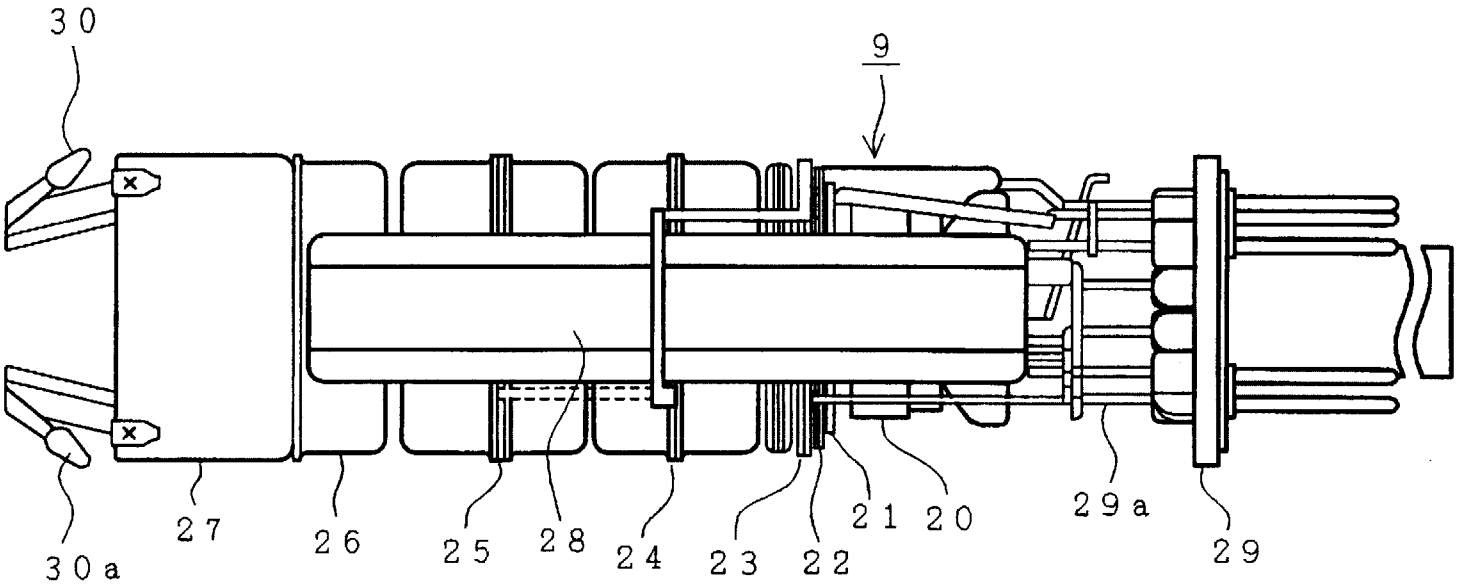
FIG. 5 is a side elevational view of an electron gun assembly for the cathode ray tube according to the present invention.

FIG. 5 is a side elevational view of the electron gun assembly used in the cathode ray tube of the present embodiment. The electron gun assembly includes a heater (not shown), cathodes 20, a first grid electrode 21, a second grid electrode 22, a third grid electrode 23, a fourth grid electrode 24, a fifth grid electrode 25, a sixth grid electrode (anode) 26, the shield cup 27, the beading glass 28, the stem 29 and the contact springs 30.

As shown in FIG. 5, the cathodes 20 and each of the grid electrodes 21, 22, 23, 24, 25 and 26 are fixed at predetermined intervals in a predetermined arrangement by the beading glass 28, and the shield cup 27 is fixed to the sixth grid electrode (anode) 26 by welding, for example. The cathodes 20 and the grid electrodes 21, 22, 23, 24, 25 and 26 are connected to predetermined stem pins 29*a* provided on the stem 29, directly or via a lead wire.

In the electron gun assembly of the present embodiment, a high voltage (anode voltage) to be supplied to the sixth grid electrode 26, which is the anode, is supplied from the electrically conductive coating applied to the inner wall of the funnel portion via the contact springs 30 and the shield cup 27. The contact springs 30 are made of an alloy material which is composed of 30–35 wt % nickel (Ni), 19–23 wt % chromium (Cr) and the balance of which is substantially iron (Fe), and which has a micro Vickers hardness of 250–400.

Figure 6:
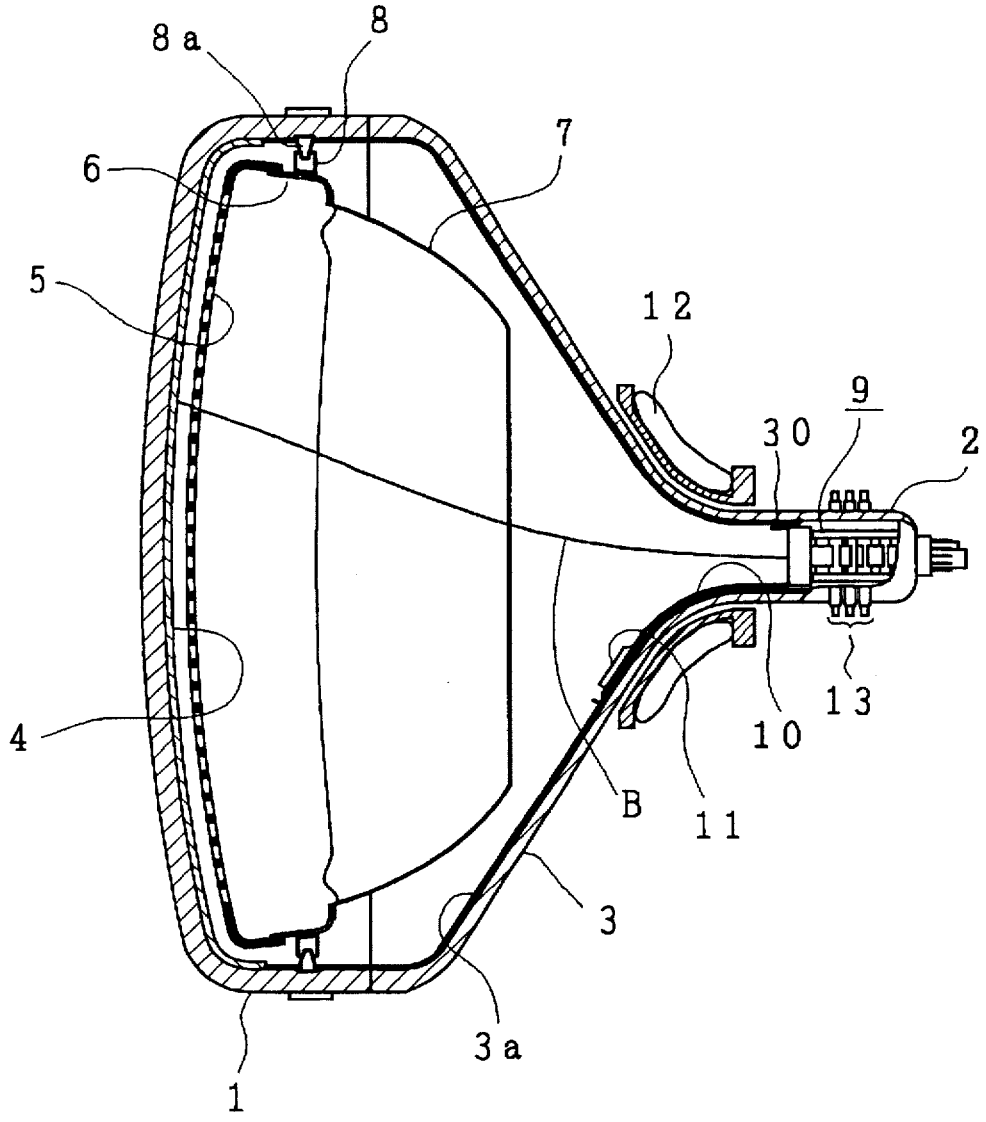
FIG. 6 is a cross-sectional view of an example of the construction of a color cathode ray tube according to the present invention.

FIG. 6 is a cross-sectional view of the cathode ray tube of the present embodiment, showing a color cathode ray tube provided with the electron gun assembly shown in FIG. 5. The cathode ray tube shown in FIG. 6 includes a face panel portion 1, the neck portion 2, the funnel portion 3, the electrically conductive coating 3*a*, a phosphor screen 4, a shadow mask 5, a mask frame 6, an inner magnetic shield 7, support springs 8, studs 8*a*, the electron gun assembly 9, a getter spring 10, a getter 11, a deflection yoke assembly 12, an electron beam static convergence adjustment magnet assembly 13, and the contact spring 30. Symbol B denotes electron beams (one of which only is shown).

In the color cathode ray tube shown in FIG. 6, the face panel portion 1, the neck portion 2 and the funnel portion 3 constitute a vacuum vessel, and the phosphor screen 4 is formed on the inner surface of the face panel portion 1. The shadow mask 5, having many apertures and which is fixed to the mask frame 6, is disposed close to the phosphor screen 4. The support springs 8 are fixed to this mask frame 6, and are engaged in the studs 8*a* embedded in the inner wall of the face panel portion 1, thereby supporting the shadow mask 5. The inner magnetic shield 7 is attached to the mask frame 6 to prevent an external magnetic field from affecting the trajectory of the electron beam B.

The electron gun assembly 9 is accommodated in the neck portion 2, and one end of each of the contact springs 30 is fixed to the shield cup 27 disposed at the front end of the electron gun assembly 9. The other end of each of the contact springs 30 is pressed against the electrically conductive coating 3*a* applied to the inner wall of the neck portion 2. In this manner, the contact springs 30 hold the electron gun assembly 9 coaxially with the tube axis of the electron gun assembly 9, and supply a high voltage from the electrically conductive coating 3*a* to the anode of the electron gun assembly 9.

Figure 7:
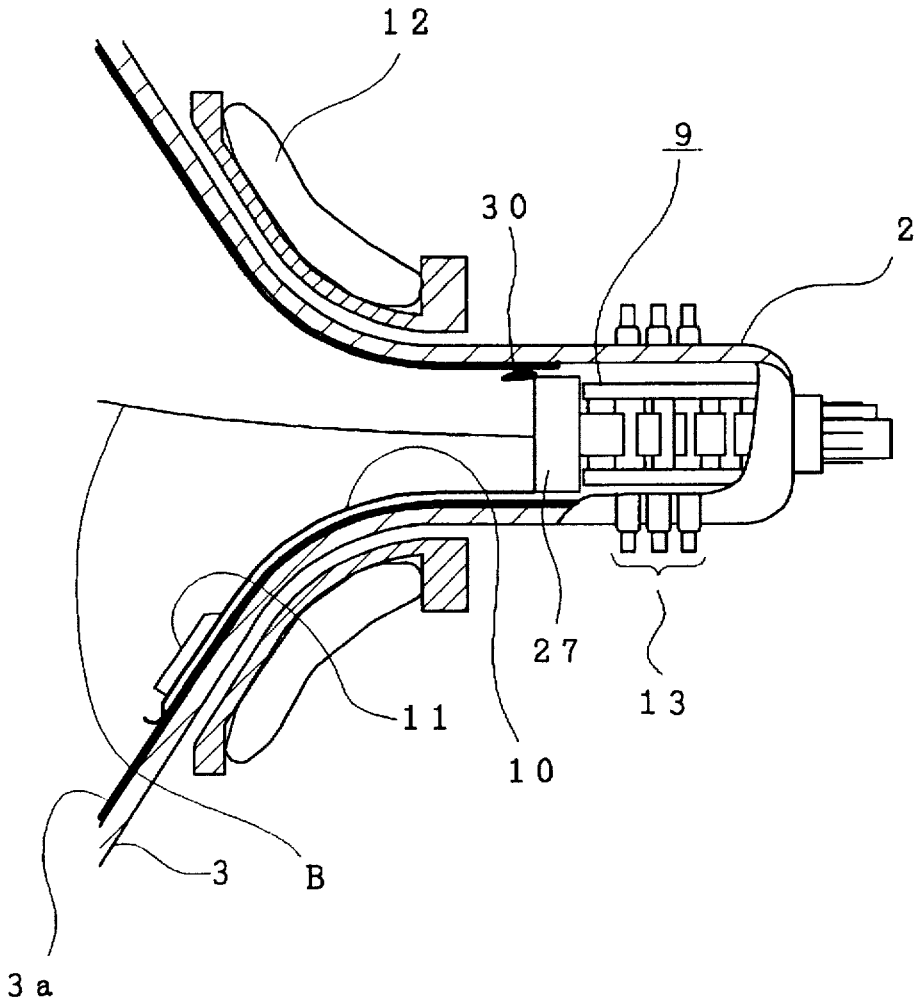
FIG. 7 is a partial sectional view of a getter spring arrangement for the color cathode ray tube according to the present invention.

Further, in the cathode ray tube of the embodiment shown in FIG. 6, one end of the getter spring 10 is fixed to the shield cup 27 of the electron gun assembly 9 and the getter 11 is mounted on the getter spring 10 in the vicinity of the other end thereof, which is pressed against the electrically conductive coating 3*a*. The getter spring 10 aids in holding the electron gun assembly 9 coaxially with the tube axis, and supplies the high voltage from the conductive coating 3*a* to the anode of the electron gun assembly 9. The details are shown in FIG. 7.

Since an alloy material, which is composed of 30–35 wt % nickel (Ni), 19–23 wt % chromium (Cr) and the balance of which is substantially iron (Fe), having a micro Vickers hardness of 250–400, is used for the contact springs and/or the getter spring of the aforesaid color cathode ray tube of the present embodiment, it is possible to prevent the scraping of the electrically conductive coating by the press contact portions of the contact springs and the getter spring. The color cathode ray tube of the present embodiment is capable of avoiding the problem that particles of the electrically conductive coating are produced and remain in the neck portion when the electron gun is inserted into the neck portion, causing sparking or the blocking of shadow-mask electron beam passing openings, thereby degrading the display image.

As described above, with the cathode ray tube of the present invention, it is possible to reliably provide an electrical connection between the electron gun assembly and the electrically conductive coating without scraping the conductive coating, and it is further possible to hold the electron gun assembly at a predetermined position coaxially in the neck portion of the glass tube.

As to the alloy material used for the contact springs of the cathode ray tube of the present invention, i.e., an alloy material which is composed of 30–35 wt % nickel (Ni), 19–23 wt % chromium (Cr) and the balance of which is substantially iron (Fe), having a micro Vickers hardness of 250–400, the content of expensive nickel (Ni) can be reduced to a half or less, compared to the conventional alloy material (75/15 inconel alloy) which is composed of 72–78 wt % nickel (Ni), 14–16.6 wt % chromium (Cr) and the balance of which is substantially iron (Fe), and having a micro Vickers hardness of more than 300.

What is claimed is;

1. A cathode ray tube comprising: a vacuum vessel provided with a face panel portion, a neck portion, and a funnel portion which interconnects said face panel portion and said neck portion; a phosphor screen formed on an inner surface of said face panel portion; an electron gun assembly accommodated in said neck portion for projecting an electron beam toward said phosphor screen; and a contact spring fixed at one end to a shield cup of said electron gun assembly and pressed at the other end against an electrically conductive coating on an inner wall of said funnel portion.

wherein said contact spring is made of an alloy material which is composed of 30–35 wt % nickel (Ni), 19–23 wt % chromium (Cr) and the balance of which is substantially iron (Fe), and has a micro Vickers hardness of 250–400.

2. A cathode ray tube according to claim 1, wherein a getter spring is fixed at one end to said shield cup of said electron gun assembly and a getter is held at the other end of said getter spring and is in contact with said electrically conductive coating, and said getter spring is made of an alloy material which is composed of 30–35 wt % nickel (Ni), 19–23 wt % chromium (Cr) and the balance of which is substantially iron (Fe), and has a micro Vickers hardness of 250–400.

3. A cathode ray tube comprising: a vacuum vessel provided with a face panel portion, a neck portion, and a funnel portion which interconnects said face panel portion and said neck portion; a phosphor screen formed on an inner surface of said face panel portion; a color selective electrode disposed close to said phosphor screen and supported on a peripheral inner wall of said face panel portion via a support spring; an electron gun assembly accommodated in said neck portion for projecting an electron beam toward said phosphor screen; and a plurality of contact springs each of which is fixed at one end to a shield cup of said electron gun assembly and is pressed at the other end thereof against an electrically conductive coating applied to an inner wall of said funnel portion, wherein said contact springs are made of an alloy material which is composed of 30–35 wt % nickel (Ni), 19–23 wt % chromium (Cr) and the balance of which is substantially iron (Fe), and has a micro Vickers hardness of 250–400.

4. A cathode ray tube according to claim 3, wherein a getter spring is fixed at one end to said shield cup of said electron gun assembly and a getter is held at the other end which is in contact with said electrically conductive coating, and said getter spring is made of an alloy material which is composed of 30–35 wt % nickel (Ni), 19–23 wt % chromium (Cr) and the balance of which substantially iron (Fe), and has a micro Vickers hardness of 250–400.

5. A cathode ray tube according to claim 3, wherein said support spring for said color selective electrode is made of an alloy material which is composed of 30–35 wt % nickel (Ni), 19–23 wt % chromium (Cr) and the balance of which is substantially iron (Fe), and has a micro Vickers hardness of 250–400.

6. An electron gun assembly for a cathode ray tube, comprising: a heater; a cathode; a grid electrode; an anode; a beading glass for fixing said cathode, said grid electrode and said anode at predetermined positions; a shield cup fixed to said anode; and a contact spring fixed at one end to said shield cup, wherein said contact spring is made of an alloy material which is composed of 30–35 wt % nickel (Ni), 19–23 wt % chromium (Cr) and the balance of which is substantially iron (Fe), and has a micro Vickers hardness of 250–400.

* * * * *